US006021903A

United States Patent [19]

Hanson

[11] Patent Number: 6,021,903

[45] Date of Patent: Feb. 8, 2000

[54] PLASTIC CONTAINER WITH SAUCE CUP HOLDER

[75] Inventor: Scott A. Hanson, Buffalo Grove, Ill.

[73] Assignee: Tenneco Packaging Inc., Lake Forest, Ill.

[21] Appl. No.: 09/027,164

[22] Filed: Feb. 20, 1998

[51] Int. Cl.[7] ..... B65D 51/28

[52] U.S. Cl. ..... 206/541; 220/212; 220/522; 426/120

[58] Field of Search ..... 206/216, 501, 206/514, 541, 549, 568; 220/23.83, 212, 521, 522; 426/120

[56] References Cited

U.S. PATENT DOCUMENTS

| | | | |
|---|---|---|---|
| D. 364,090 | 11/1995 | Krupa . | |
| 1,514,379 | 11/1924 | Fleischer | 426/120 |
| 2,802,590 | 8/1957 | Tupper | 220/522 |
| 3,732,955 | 5/1973 | Carter | 220/522 |
| 4,600,592 | 7/1986 | Dobis | 426/120 |
| 4,636,328 | 1/1987 | Flynn et al. | 220/522 |

OTHER PUBLICATIONS

IVEX Product Sheet, "Shrimp Server", IVEX Packaging Corporation, Lincolnshire, Illinois, 2 pgs.

Tray–Pak Brochure, "Tray–Pak Custom Thermoformed Packaging", Tray–Pak Corporation, 8 pgs.

Ultra Pac Catalog, "Catalog—Effective Mar., 1995 Ultrafresh™", Ultra Pac, Inc., p. 18.

4 sheets of drawings (FIGs. 1–7) from Serial No. 29/046, 491.

*Primary Examiner*—Jim Foster

*Attorney, Agent, or Firm*—Arnold White & Durkee

[57] ABSTRACT

A plastic container includes a lid and a base optionally connected to each other along a hinge. The lid includes a top wall having an integral sauce cup holder for engaging and suspending a sauce cup from the top wall above a bottom wall of the base. The sauce cup holder preferably includes a plurality of clips spaced equidistant from each other. These clips are spaced sufficiently apart such that they allow an upper peripheral rim of the sauce cup to be easily snapped into place with a top portion of the sauce cup immediately adjacent to the top wall of the lid.

14 Claims, 5 Drawing Sheets

PLASTIC CONTAINER WITH SAUCE CUP HOLDER

FIELD OF THE INVENTION

The present invention relates generally to food packaging and, more particularly, relates to a plastic container having a holder for engaging a sauce cup and suspending the sauce cup from a top wall of the container above a bottom wall thereof.

BACKGROUND OF THE INVENTION

Agricultural produce such as berries are commonly sold to consumers in vented plastic containers. Such a container typically includes a lid and a base. The lid may be connected to the base along a hinge. An absorbent or cushioning pad can be layered across the bottom of the base. To allow air to circulate through the container and thereby maintain the freshness of the produce therein, a plurality of vents are formed in the lid and/or the base.

The produce sold in the aforementioned plastic containers is often consumed with some type of dipping sauce. For example, strawberries may be dipped into a chocolate sauce prior to consumption. To facilitate this combination of produce and dipping sauce and thereby foster the sale of produce, a sauce cup may be loosely placed in the same container as the produce. A well-forming pedestal may be formed in the bottom of the container base to hold the sauce cup.

One drawback of having the sauce cup resting in the pedestal on the base bottom is that a hole must be cut in the absorbent or cushioning pad, if used, to accommodate the pedestal. Cutting the hole in the pad adds to the cost of manufacturing the plastic container. This additional cost may be absorbed by those involved in manufacturing the container in the form of lower profit margins or, more likely, may be passed on to consumers in the form of higher purchase prices.

Another drawback of having the sauce cup resting in the pedestal on the base bottom is that the volume available inside the container for storing the produce is significantly reduced. The pedestal occupies significant volume which otherwise could be used by the produce.

A further drawback of having the sauce cup resting in the pedestal on the base bottom is that the pedestal unduly restricts the allowable height of the sauce cup packaged in the container. The pedestal elevates the sauce cup above the lowermost portion of the base bottom and, consequently, the sauce cup can have a height no greater than the space between the pedestal and the top of the container lid.

Yet another drawback of having the sauce cup loosely placed in the container, whether or not the sauce cup is supported by a pedestal on the base bottom, is that the sauce cup can be obscured by the produce in the container. Any difficulty in viewing the sauce cup can compromise the marketing advantages attendant to packaging the sauce cup with the produce.

A need therefore exists for a plastic container that overcomes the above shortcomings associated with existing produce containers having pedestals for holding sauce cups. The present invention provides such a plastic container.

SUMMARY OF THE INVENTION

In accordance with the foregoing, the plastic container embodying the present invention includes a lid and a base. The lid and the base are optionally connected to each other along a hinge. The lid includes a top wall having an integral sauce cup holder for engaging and suspending a sauce cup from the top wall above a bottom wall of the base. In a preferred embodiment, the sauce cup holder includes a plurality of clips spaced equidistant from each other. These clips are spaced sufficiently apart such that they allow an upper peripheral rim of the sauce cup to be easily snapped into place with a top portion of the sauce cup immediately adjacent to the lid.

Since the sauce cup is suspended from the lid above the bottom wall of the base, an absorbent or cushioning pad can be layered across the bottom wall without the sauce cup or a supporting pedestal getting in the way. Moreover, suspending the sauce cup from the lid results in less volume loss inside of the container for storing produce. Finally, suspending the sauce cup from the lid allows sauce cups of various heights to be used, all having tops immediately adjacent to the lid for optimum visibility. The height of the sauce cup is only limited by the space between the bottom wall of the base and the top wall of the lid.

BRIEF DESCRIPTION OF THE DRAWINGS

Other objects and advantages of the invention will become apparent upon reading the following detailed description and upon reference to the drawings in which.

Figure 1:
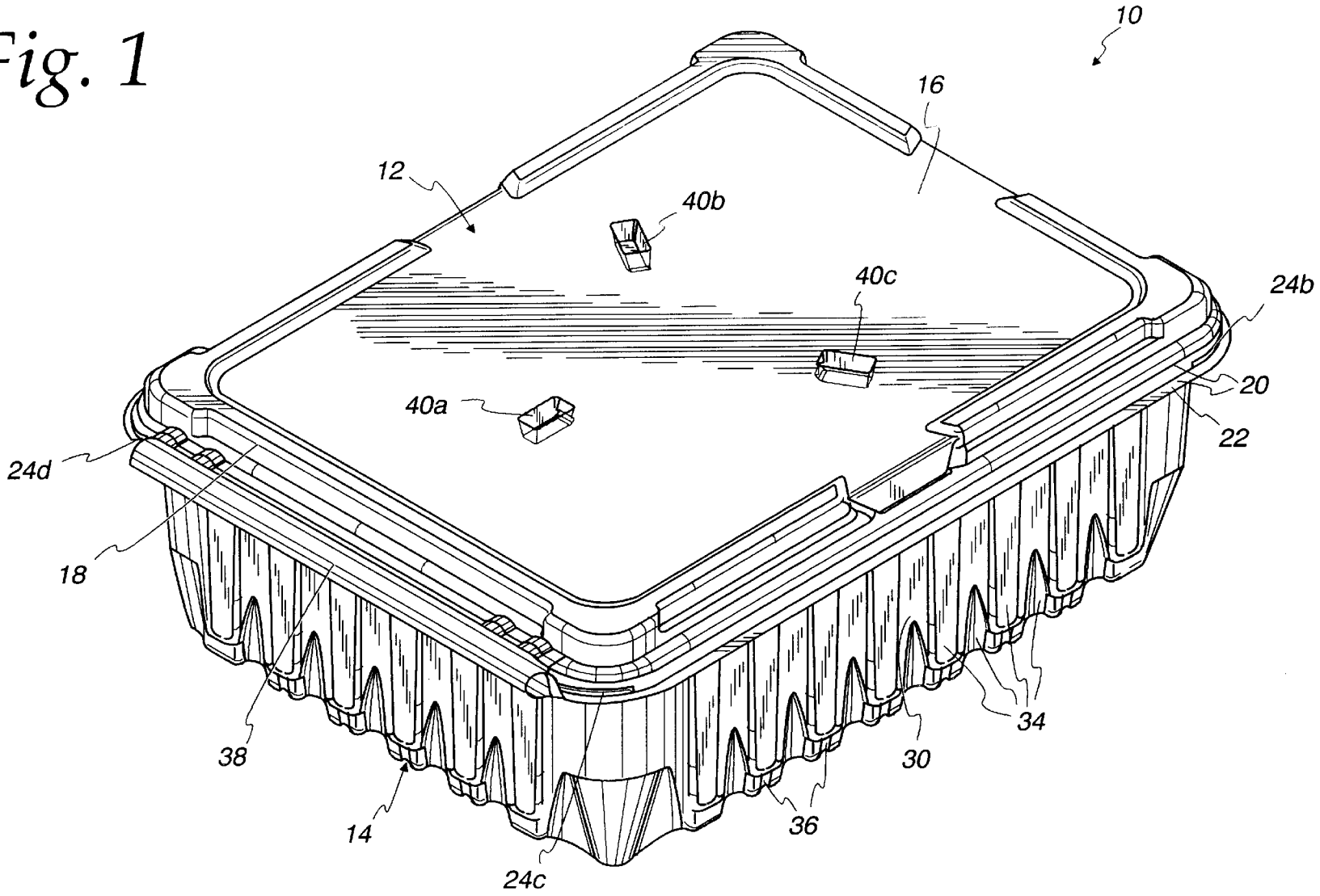
FIG. 1 is an isometric view of a closed plastic container embodying the present invention.

While the invention is susceptible to various modifications and alternative forms, a specific embodiment thereof has been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE PREFERRED EMBODIMENT

Figure 2:
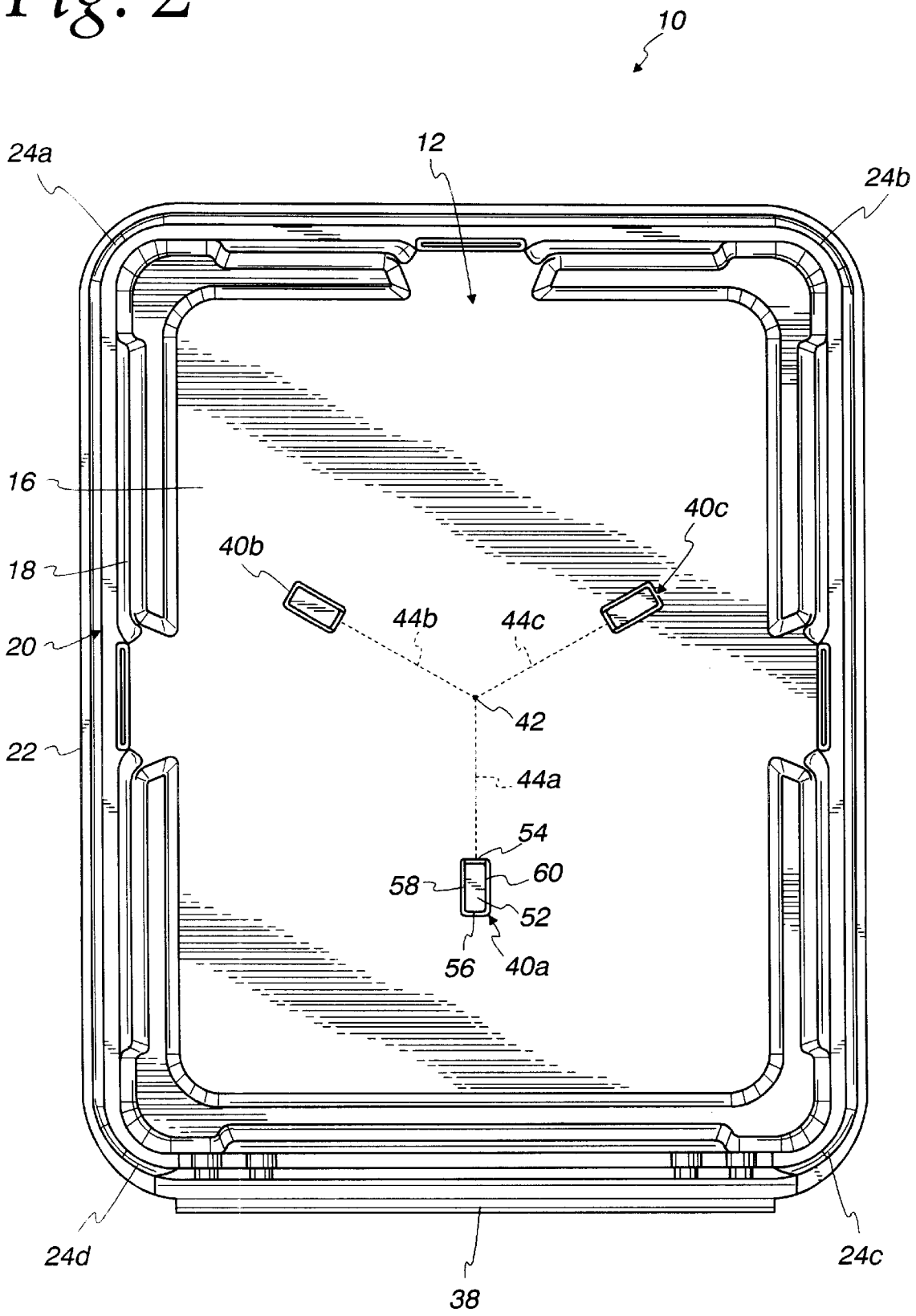
FIG. 2 is a top view of the closed plastic container.
Figure 6:
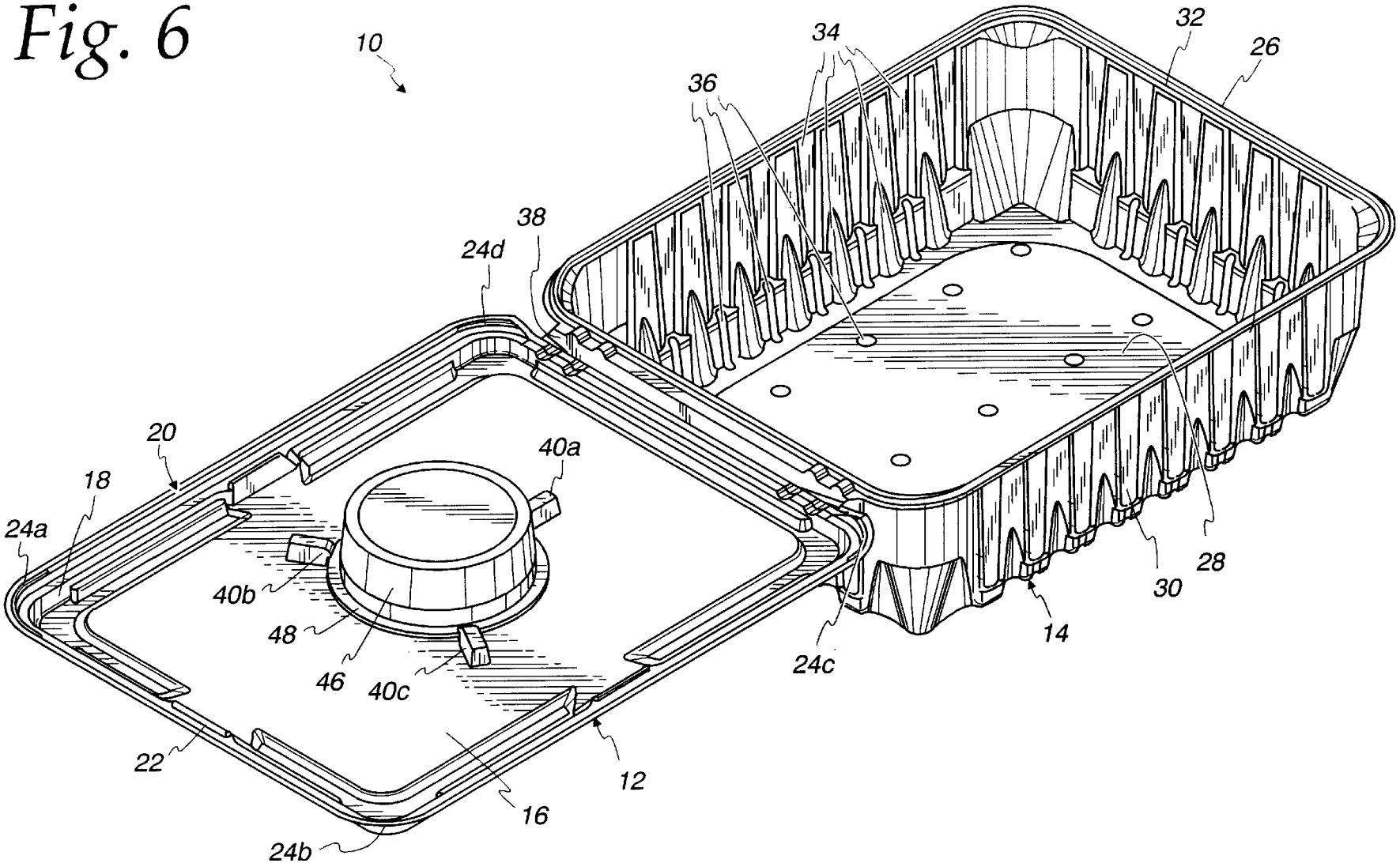
FIG. 6 is an isometric view of the plastic container in an open position with the sauce cup engaged to the lid.

Turning now to the drawings, FIGS. 1, 2, and 6 depict a plastic container 10 embodying the present invention. The plastic container 10 is preferably composed of a molded thermoplastic material such as oriented polystyrene (OPS) or polyethylene terephthalate (PET). The plastic container 10 includes a lid 12 and a base 14. The lid 12 includes a top wall 16, a side wall 18, and a rim 20. The side wall 18 encompasses and extends downward from the top wall 16. The rim 20 encompasses the side wall 18 and extends downward and laterally outward from the side wall 18, and the rim 20 forms a peripheral flange 22. The rim 20 includes four comer undercuts 24*a–d* that snappingly engage with respective corner portions of a flange 26 (see FIGS. 4 and 6) of the base 14 to lock the container 10 in a closed position.

The base 14 includes a bottom wall 28 (FIG. 6), a side wall 30, and a rim 32. The side wall 30 encompasses the bottom wall 28 and extends upward and outward from the bottom wall 28. The rim 32 extends laterally outward from the side wall 30 and forms the peripheral flange 26 (FIG. 6) noted above. To provide the plastic container 10 with top load compression strength, the side wall 30 forms a plurality of generally vertical rib structures 34 that extend between the bottom wall 28 and the rim 32. Both the side wall 30 and the bottom wall 28 include a plurality of vents 36 (FIG. 6) to allow air to circulate through the container 10 and thereby maintain the freshness of the produce therein. It is contemplated that the location and configuration of the rib structures 34 and the vents 36 can be varied.

The rim 20 of the lid 12 and the rim 32 of the base 14 are optionally connected to each other along an integral hinge 38. When the container 10 is opened by disengaging the comer undercuts 24*a–d* of the lid 12 from the flange 26 of the base 14, the lid 12 can be rotated upward relative to the base 14 about the hinge 38. FIG. 6 depicts the container 10 in a completely open position.

Referring to FIG. 2, the top wall 16 of the lid 12 forms an integral sauce cup holder 40*a–c* for engaging a sauce cup and suspending the sauce cup from the lid 12 above the bottom wall of the base. The sauce cup holder includes a plurality of clips 40*a–c* spaced equidistant from each other about an imaginary center point 42. The imaginary center point 42 corresponds to the center of the top wall 16 of the lid 12. However, it is contemplated that the clips 40*a–c* can be shifted closer to an edge or comer of the top wall 16 so that the center point 42 is likewise shifted closer to that edge or comer of the top wall 16.

If imaginary radial lines 44*a–c* are extended from the center point 42 to the respective clips 40*a–c*, the inclusive angle (smallest angle) between any two of these radial lines is 120 degrees. The preferred number of discrete clips is three, but it is contemplated that the number of clips could be reduced to two or increased to four or more. Alternatively, the discrete clips 40*a–c* could be replaced with one circular recess or channel having a radius equivalent to the length of the radial lines 44*a–c*. Moreover, the discrete clips 40*a–c* need not be equidistant from each other; for example, the clips 40*b–c* could be moved closer to each other such that the inclusive angle between the radial lines 44*b–c* is less than 120 degrees. The length of these radial lines 44*a–c* is sufficiently great that the clips 40*a–c* allow an upper peripheral rim of the sauce cup to be easily snapped into place with a top portion of the sauce cup immediately adjacent to the lid 12. Further, the clips 40*a–c* can be used to engage sauce cups having other shapes, i.e. square, rectangular, oval, etc.

Figure 3:
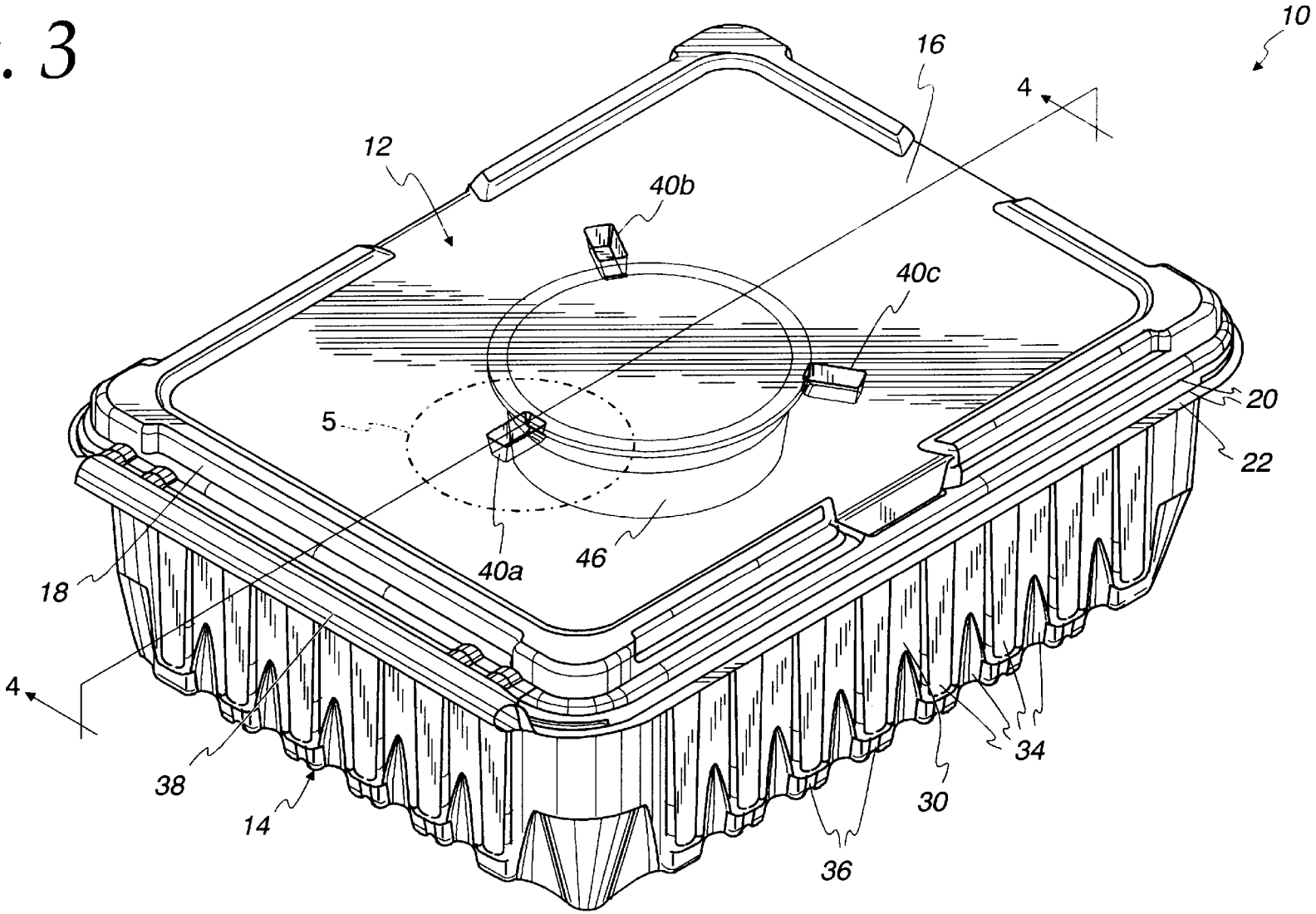
FIG. 3 is an isometric view of the closed plastic container with a sauce cup suspended from a lid of the container.
Figure 4:
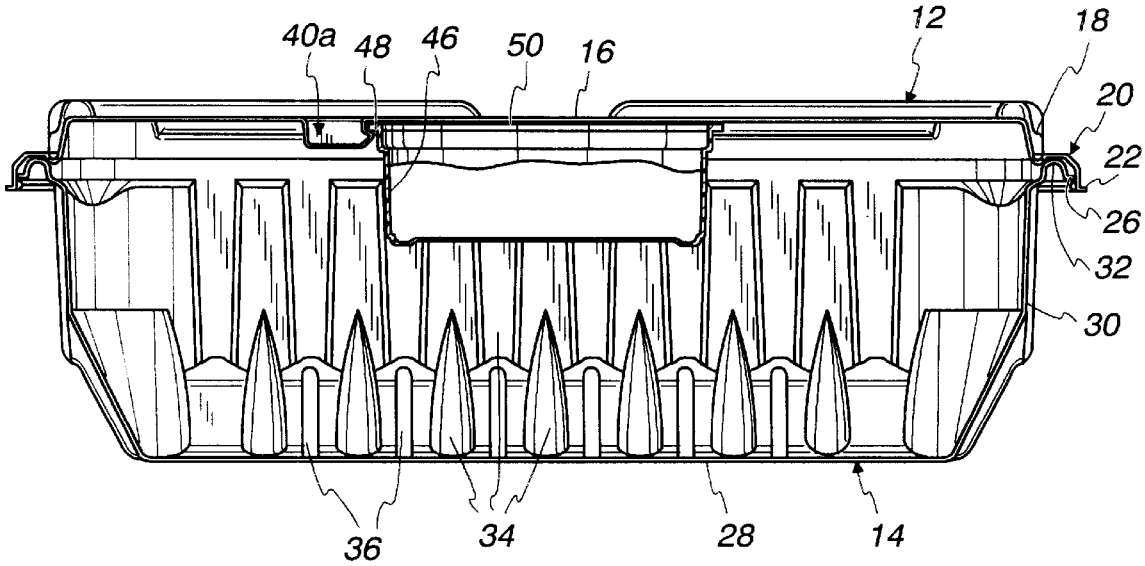
FIG. 4 is a section view taken generally along line 4—4 in FIG. 3.

FIGS. 3 and 4 illustrate the closed plastic container 10 with a sauce cup 46 suspended from the lid 12. The sauce cup 46 includes an upper peripheral rim 48 engaged to the clips 40*a–c* and a top portion 50 immediately adjacent to the top wall 16 of the lid 12. Since the section view in FIG. 4 is taken along line 4—4 in FIG. 3, only the clip 40*a* is depicted in FIG. 4.

Figure 5:
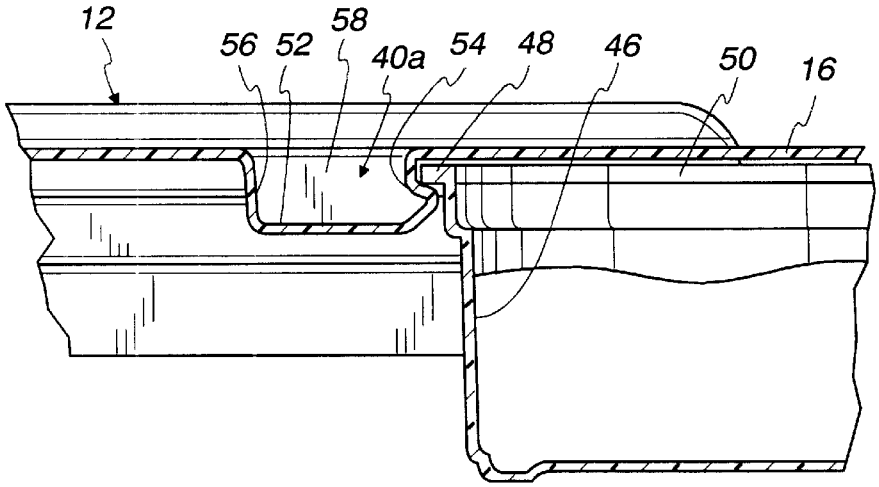
FIG. 5 is an enlarged portion of the section view of FIG. 4.

The clips 40*a–c* are identical in construction, so only the clip 40*a* is described in detail below. As best shown in FIGS. 2 and 5, the clip 40*a* is in the form of a generally rectangular indentation or recess depending from the top wall 16 of the lid 12. The clip 40*a* includes a bottom wall 52, opposing inner and outer walls 54 and 56, and a pair of opposing side walls 58 and 60. The walls 56, 58, and 60 are generally planar, and the side walls 58 and 60 extend between the inner and outer walls 54 and 56. The outer wall 56 extends upwardly and slightly outwardly from the bottom wall 52 and intersects the horizontal portion of the top wall 16. Likewise, the side walls 58 and 60 extend upwardly and slightly outwardly from the bottom wall 52 and intersect the horizontal portion of the top wall 16. Although the clips 40*a–c* are depicted as generally rectangular, they could be any shape (e.g. elliptical, polygonal, etc.). Also, although the clips 40*a–c* are illustrated as being identical to each other, the clips could be different from one another.

Unlike the walls 56, 58, and 60, the inner wall 54 is not generally planar. Rather, the inner wall 54 forms an undercut for engaging the rim 48 of the sauce cup 46 as shown in FIG. 5. The contour of the undercut can be fairly sharp as shown or more gradual. Moreover, the undercut can be arced to follow the curved outer edge of the sauce cup rim 48. If the clips 40*a–c* are replaced with one circular recess or channel as discussed above, the inner wall of the circular recess could form one continuous circular undercut or a series of spaced undercuts.

Since the sauce cup 46 is suspended from the lid 12 above the bottom wall 28 of the base 14, an absorbent or cushioning pad can be layered across the bottom wall 28 without cutting any special holes in the pad. Moreover, suspending the sauce cup 46 from the lid 12 minimizes volume loss inside of the container 10 for storing produce. Finally, suspending the sauce cup 46 from the lid 12 allows sauce cups of various heights to be used, all having tops 50 immediately adjacent to the lid 12 for optimum visibility. The height of the sauce cup 46 is only limited by the space between the bottom wall 28 of the base 14 and the top wall 16 of the lid 12. Once the container 10 is opened as shown in FIG. 6, the sauce cup 46 is easily disengaged from the clips 40*a–c* by grasping the sauce cup 46 and pulling the sauce cup away from the lid 12.

While the present invention has been described with reference to one or more particular embodiments, those skilled in the art will recognize that many changes may be made thereto without departing from the spirit and scope of the present invention. For example, the clips 40*a–c* can be repositioned to engage and thereby suspend sauce cup rims having different shapes and sizes. Furthermore, the sauce cup holder need not be in the form of clips, but rather could be in the form of a food grade hot melt adhesive that adheres the top portion 50 of the sauce cup 46 to the lid 12. Also, the sauce cup holder need not be limited to use with produce containers, but rather could also be used with containers in food service applications. Each of these embodiments and obvious variations thereof is contemplated as falling within the spirit and scope of the claimed invention, which is set forth in the following claims.

What is claimed is:

1. A plastic container, comprising:

a base including a bottom wall; and a lid for covering said base and including a top wall opposing said bottom wall, said lid including means for engaging and suspending a sauce cup from said top wall of said lid above said bottom wall of said base.

2. The container of claim 1, wherein said base includes a first side wall and a first rim, said first side wall encompassing and extending upward from said bottom wall, said first rim encompassing and extending laterally outward from said first side wall, and wherein said lid includes a second side wall and a second rim, said second side wall encompassing and extending downward from said top wall, said second rim encompassing and extending laterally outward from said second side wall, said first and second rims being releasably engageable to each other.

3. The container of claim 2, wherein said first and second rims are connected to each other along a hinge.

4. The container of claim 1, wherein said sauce cup includes a top portion having a peripheral rim, and wherein said means for engaging and suspending said sauce cup includes a plurality of clips for engaging said peripheral rim of said top portion of said sauce cup.

5. The container of claim 4, wherein said clips are spaced equidistant from each other.

6. The container of claim 4, wherein said clips are positioned such that said top portion of said sauce cup is immediately adjacent to said top wall in response to engaging said peripheral rim with said clips.

7. The container of claim 4, wherein each of said clips is an indentation depending from said top wall.

8. The container of claim 7, wherein said indentation includes an inner wall forming an undercut for engaging said peripheral rim of said sauce cup.

9. The container of claim 8, wherein said indentation is generally rectangular in shape, said indentation including a bottom wall, an outer wall, and a pair of opposing side walls, said outer wall opposing said inner wall, said inner and outer walls extending upward from said bottom wall, said side walls extending upward from said bottom wall and extending between said inner and outer walls.

10. The container of claim 4, wherein said plurality of clips includes three clips.

11. A plastic container, comprising:

a base; and a lid for covering said base, said lid including an integral sauce cup holder for engaging an upper peripheral rim of a sauce cup and suspending a sauce cup from said lid in an interior of said container, wherein said sauce cup holder includes three clips spaced equidistant from each other.

12. The container of claim 11, wherein said sauce cup holder is positioned such that said upper peripheral rim of said sauce cup is immediately adjacent to said lid in response to engaging said peripheral rim with said sauce cup holder.

13. The container of claim 11, wherein said lid includes a top wall and each of said clips is an indentation depending from said top wall.

14. The container of claim 13, wherein said indentation includes an inner wall forming an undercut for engaging said upper peripheral rim of said sauce cup.

* * * * *